United States Patent [19]

Scheer

[11] 4,251,877

[45] Feb. 17, 1981

[54] CLOCK, ESPECIALLY STRIKER CLOCK

[75] Inventor: Erich Scheer, St. Georgen-Peterzell, Fed. Rep. of Germany

[73] Assignee: KUNDO-Kieninger & Obergfell, St. Georgen, Fed. Rep. of Germany

[21] Appl. No.: 972,253

[22] Filed: Dec. 22, 1978

[30] Foreign Application Priority Data

Dec. 24, 1977 [DE] Fed. Rep. of Germany ..... 2758050

[51] Int. Cl.[3] ..... G04C 21/06

[52] U.S. Cl. ..... 368/251; 368/75; 340/384 E

[58] Field of Search ..... 58/13, 23 C, 38 R, 38 A, 58/60; 340/384 R, 384 E, 392; 368/75, 251, 243, 273

[56] References Cited

U.S. PATENT DOCUMENTS

| | | | |
|---|---|---|---|
| 3,978,650 | 9/1976 | Hashimoto et al. | 58/23 AC |
| 4,073,133 | 2/1978 | Earls et al. | 58/13 |
| 4,090,349 | 5/1978 | Takase | 340/384 E |

*Primary Examiner*—Edith S. Jackmon
*Attorney, Agent, or Firm*—Karl F. Ross

[57] ABSTRACT

A signal-generating system for a striker clock comprises a clockwork-driven hour disk (12) having conductor tracks which coact with respective contact springs of an hour switch (13) whose pattern of energization changes from one quarter hour to the next, thereby calling forth different numerical values which are stored in a first read-only memory (18) and determine the number of strikes to be emitted in any 15-minute interval when a switch (8) coupled with the minute shaft of the clock is briefly closed. A flip-flop (23) set upon such closure starts a periodically pulsed binary counter (25) which works into a comparator (20) also receiving the numerical value read out from the first memory (18); when the count matches that value, the comparator resets the flip-flop and the counter. The reading of the counter is further transmitted to a decoder (30) addressing a second read-only memory (31) which actuates selected sound emitters (37a–37f) the requisite number of times. The selection of the sound emitters proceeds under a program stored in the second memory (31) which could be modified, periodically under the control of the first memory (18) or manually, to vary the acoustic effect. The flip-flop, pulse counter and comparator could be replaced by a microcomputer with input connections to the clockwork-driven minute and hour switches (8, 13) and to the two memories (18, 31) and with outputs for the selective actuation of the sound emitters (37a–37f).

12 Claims, 2 Drawing Figures

CLOCK, ESPECIALLY STRIKER CLOCK

FIELD OF THE INVENTION

My present invention relates to a clock, especially a striker clock, with preferably electrical, especially electronic clockwork as well as with a signaling device intermittently providing also an acoustic time indication which, in dependence upon the position of at least one clockwork-actuated arrangement, can be adjusted as to the number and kind of the acoustic time signals to be emitted in each instance and is preferably triggerable by the clockwork at the instant of signal emission.

BACKGROUND OF THE INVENTION

Striker clocks driven by electric motors are already known in which the kind and number of the emitted strikes or sounds is predeterminable by mechanical scanning of mechanical or electrical means depending upon the position of an indicator shaft of the clockwork. Via a further clockwork shaft, generally moving more rapidly, the emission of the sequence of strikes preselected by the first shaft is triggered when called for. This involves either, in the case of a mechanical striker, the unblocking of the power train of the driving spring assembly and its reblocking after the emission of the acoustic signal or—in the case of an electric-motor drive—the cut-in of a miniature electric motor at the beginning of the emission of the acoustic time signal and its cutout at the end thereof.

These known arrangements, however, are relatively complex and cumbersome in their mechanical structure. They are expensive to manufacture and, furthermore, require relatively much space for their accommodation in the clock housing. They are, moreover, often prone to malfunction and sensitive to external influences such as thrusts and impacts, but also to contamination by dust, thickened oil etc.

Besides, the signal sequence to be emitted for indicating the time is fixedly preset in many cases so that a variation or modification is possible only with difficulty, e.g. by manual intervention, and often only in permanent fashion.

OBJECT OF THE INVENTION

The object of the invention is, therefore, to provide an improvement over known arrangements enabling, with smaller investment and a less complicated structure, a compact and operationally reliable construction of such a clock with sound-emitting means for acoustically indicating the time at regular intervals, specifically every hour.

SUMMARY OF THE INVENTION

I realize this object, in accordance with my present invention, by the provision of switch means mechanically coupled with the clockwork of the timepiece, more particularly with its hour shaft, for producing a succession of control signals which change from one time interval to the next, i.e. every quarter hour in the case here specifically envisaged. A memory, preferably of the read-only type, stores a multiplicity of numerical values, each representing a number of strikes associated with a respective time interval occurring during a 12-hour period, and is addressable by the switch means for reading out the respective numerical value during each such time interval. The numerical value thus read out is translated, by normally inactive conversion means advantageously including another read-only memory, into a corresponding number of excitation commands for the sound-emitting means of the striker clock, the conversion means being activated at a given instant of each time interval (i.e. on the full, quarter, half and three-quarter hour with quarter-hour strikes) by trigger means mechanically coupled with the clockwork, more particularly with its minute shaft.

The switch means generating the control signals may comprise, pursuant to a more specific feature of my invention, a rotary carrier of conductor tracks coacting with respective contacts whose pattern of energization by these tracks, communicated via a suitable decoder to the memory storing the numerical values of the strike sequence, constitute the aforementioned control signals. The trigger means may comprise a similar disk with contacts forming part of another switch whose brief closure every 15 minutes actuates a pulse generator to initiate the emission of the appropriate strike sequence. If the readout of the numerical value assigned to a given time interval persists throughout that interval, the corresponding strike sequence can also be called forth at other instants by the closure of a manual switch (referred to hereinafter as a repetition switch) actuating the pulse generator out of turn.

The conversion means may include, aside from the second read-only memory referred to above, a flip-flop settable by a trigger pulse to start the advance of a normally blocked binary counter receiving stepping pulses from a separate source. When the reading of that counter matches the numerical value read out from the first memory, a comparator resets the flip-flop along with the counter. These components could also be replaced, however, by a microcomputer dialoguing with the two read-only memories.

The second memory may be programmed to vary not only the number of sounds emitted in each strike sequence (as determined by the numerical values read out from the first memory) but also the mode of excitation of the sound-emitting means which, for this purpose, may comprise a multiplicity of selectively operable sound emitters. In accordance with another feature of my invention, the two memories are interconnected for modifying that program in different subdivisions of a 12-hour period.

BRIEF DESCRIPTION OF THE DRAWING

The above and other features of my invention will now be described in detail with reference to the accompanying drawing in which.

SPECIFIC DESCRIPTION

Figure 1:
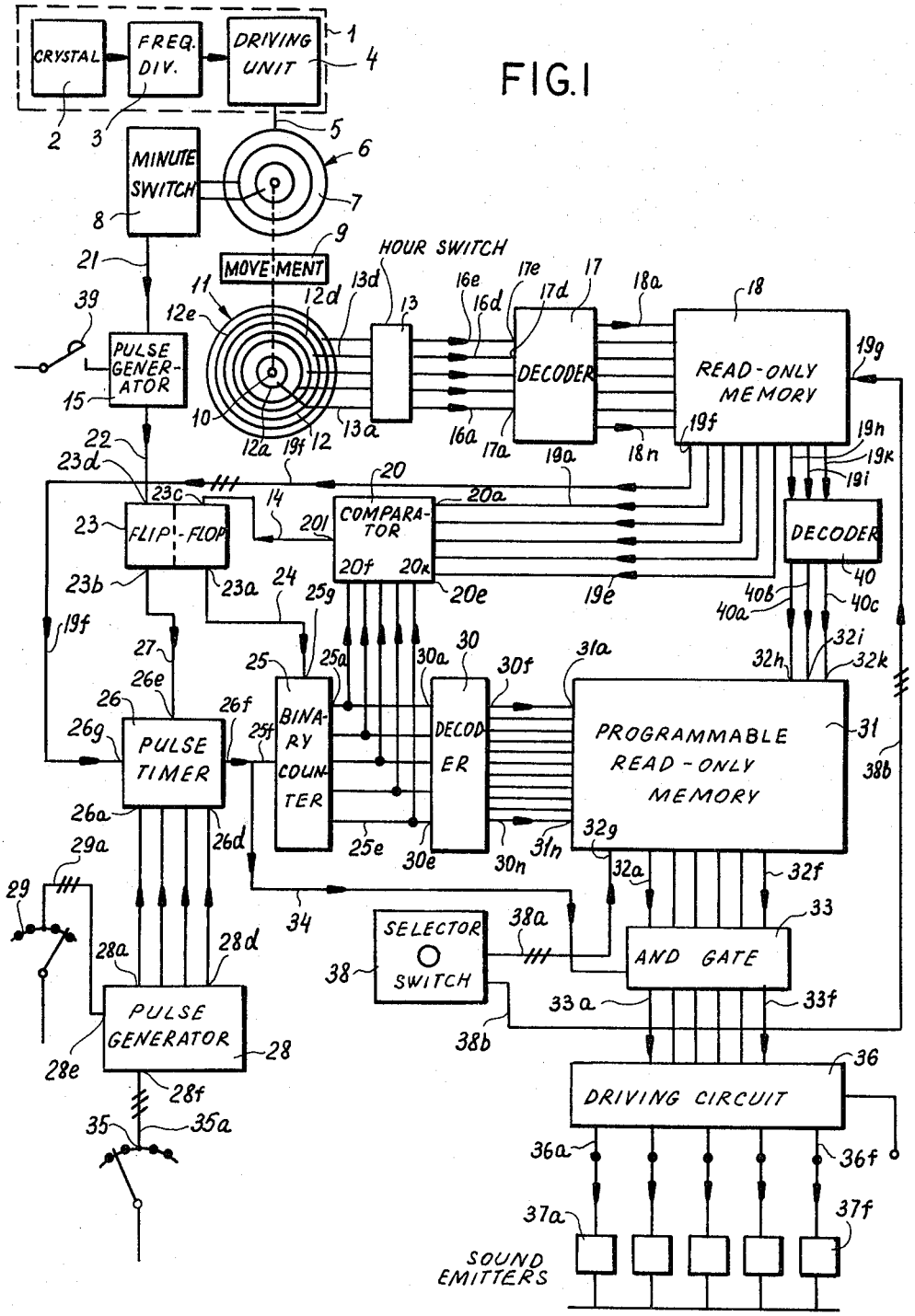
FIG. 1 represents a block diagram of a first embodiment of the invention.

In FIG. 1 there is represented at 1 the clockwork required for the control of the striker mechanism. This clockwork advantageously is of the crystal-controlled type and is constituted by a control quartz 2, a frequency divider 3 and a driving unit 4. The driving unit 4 advantageously comprises as a mechanical driving element a polarized stepping motor which is energized or controlled by a power and pulse-narrowing stage, not further referenced and illustrated, associated therewith and included in unit 4.

A minute shaft 5 extending from the driving unit 4 carries the nonillustrated minute hand and actuates a minute-contact device 6 which consists of a rotary disk 7 and a switch 8 operable thereby.

It is desirable to provide on the driving unit also the output for a seconds hand. This output can be disposed concentrically or eccentrically with reference to minute shaft 5. Especially with the use of a quartz as a timing element, the purchaser of a clock, especially a striker clock according to the invention, will be interested in having available in certain cases the possibility of a time indication exact to the second.

In other instances of use, e.g. with certain antique grandfather clocks etc., the inclusion of a seconds hand may not be desirable for stylistic reasons. It is, however, advantageous to provide the possibility for the addition of a seconds hand.

Via a clock-hand movement 9 an hour shaft 10 is driven which operates an hour-contact device 11 consisting in turn of a rotary disk 12 and a set of contacts 13*a*–13*e* forming part of a multiple switch 13.

The minute-contact device 6 effects at each full $\frac{1}{4}$ hour (00, 15, 30 and 45 minutes) a temporary contact closure via the switch 8 which, in a subsequent pulse-generator circuit 15, causes the emission of a brief trigger pulse.

The hour-contact device 11 effects via disk 12, comprising several conductor tracks 12*a*–12*d*, the selective energization of the individual contact springs 13*a*–13*d* of the hour switch 13 according to a certain control code. It will be assumed that the clock is to emit quarter-hour and hour strikes, the hour strike being emitted only on the full hour as is customary.

Thus, with the maximum number of 12-hour strikes there would be $12+3$ ($\frac{1}{4}$, $\frac{1}{2}$, $\frac{3}{4}$) distinct strike sequences to be emitted during the 12 hours and therefore also to be marked by the hour-contact device 11. With use of a binary code, four individual contacts 13*a*–13*d* of the hour switch 13 would provide $2^4=16$ possible control signals which therefore would be numerically sufficient.

Switch 13 is linked by way of connecting lines 16*a*–16*d* with respective inputs 17*a*–17*d* of a decoder 17 whose outputs 18*a*–18*n* are connected to the word conductors of an electronic memory, especially a read-only memory 18.

The reference 18*n* designates the last of a certain number of outputs which may be a number different from that corresponding to the alphabetic sequence.

Outputs leads 19*a*–19*e* of the read-only memory 18 are connected to inputs 20*a*–20*e* of a comparator 20. These outputs leads 19*a*–19*e*, which are controllable by the column conductors of the storage matrix of the read-only memory 18 either directly or via a decoder integral therewith, not further illustrated and referenced, are marked according to the loading of the word conductors 18*a*–18*n* selected in each instance by the hour-contact device 11 via decoder 17.

This marking of the output leads 19*a*–19*e*, which occurs also according to a binary code, characterizes the number of the individual signals to be emitted with each strike sequence.

This means, e.g. with a contemplated Westminster strike, that for each strike sequence of a $\frac{1}{4}$-hour strike eight individual signals are to be emitted, for a $\frac{1}{2}$-hour strike sixteen, for a $\frac{3}{4}$-hour strike twenty-four, and for a 4/4-hour strike finally thirty-two, with the addition in the last case of the respective number of hour strikes after the emission of the 4/4-hour strikes. For the performance of the strike scenario, e.g. of 4:00 o'clock, it will therefore be necessary to emit a total of $4\times8+4\times1=36$ individual signals. This number of individual signals is now to be marked on designated by a corresponding binary coding of the output leads 19*a*–19*e* of memory 18.

From the minute switch 8, as already explained, the subsequent pulse generator 15 is cut in by way of a connection 21 so as to emit a brief pulse with each contact closure. This pulse is fed via connection 22 to an RS flip-flop 23 whereby the latter is set. In the reset state of flip-flop 23, its output 23*a* brings about via a connection 24 the 0-setting of an electronic binary counter 25 by an input 25*g* thereof. In its set state, on the other hand, flip-flop 23 causes the cut-in of a pulse timer 26 by way of an output 23*b*, a connection 27 and an input 26*e*. This pulse timer 26 processes the pulses of different frequency supplied to it by a pulse generator 28 via outputs 28*a*–28*d* as well as inputs 26*a*–26*d* and transmits them by way of an output 26*f* to an input 25*f* of the electronic binary counter 25.

The pulse generator 28 is advantageously designed as a free-running oscillator, e.g. as an unstable multivibrator, which is followed by a frequency divider. The outputs 28*a*–28*d* of the pulse generator 28 originate at this associated frequency divider.

From the read-only memory 18 a further output connection 19*f* extends to an input 26*g* of the pulse timer 26. Via this output connection 19*f*, which may comprise several individual leads, the pulse timer 26 is switchable by memory 18 so as to be able to transmit pulses of different frequency to the binary counter 25. The pulse generator 28 is adjustable in its clock frequency by a manually operable switch 29. This switchover occurs in steps via another connection 29*a*, also comprising several individual leads, which extends to an input 28*a* of the pulse generator 28.

Pursuant to an advantageous embodiment the pulse generator 28 may be crystal-controlled. It is conceivable to utilze for this purpose the control quartz 2 of the clockwork 1; in fact, a unification of the switching arrangement of the control quartz 2 and the frequency divider 3 of the clockwork 1 with the pulse generator 28 is imaginable.

A frequency control of the pulse timer 26 would afford the possibility of a precise pulse emission, independent of temperature and voltage, by the pulse timer 26. This requires, however, a stepwise adjustment of the clock frequency. If, on the other hand, the pulse generator operates e.g. as an astable multivibrator, a continuous adjustment of the clock frequency to be emitted by the pulse generator 28 is possible by means of the manually operable switch 29 at the expense of a minor temperature and voltage dependency of that clock frequency; a potentiometer may be used for this purpose.

In general, a basic adaptation of the clock sequence emitted by the pulse generator 28 to the conditions prevailing in each instance will be carried out by the manually operable switch since the clock sequence—as will be more fully explained—determines the sequence of the individual signals. The selection of this clock sequence will generally occur only once, i.e. when the striker clock according to the invention is put into service, so that the switch (or adjustable resistor) 29 may also be located in a less accessible place of the clock housing.

The automatic switchover of the clock sequence of the pulse timer 26 by the read-only memory 18, via the output leaf 19*f*, is carried out during the 12-hour cycle of the strike-signal emissions at distinct instants, e.g. at 12:00 noon or midnight, in order to achieve a dignified, measured strike sequence corresponding to the distinct times of day.

A switchover of the clock sequence of the pulse timer 26 by memory 18 will also occur when—as will be explained later—the kind of strike sequence as such is to be changed over, be it by manual adjustment, be it by adjustment by the read-only memory 18 itself.

At the outputs 25*a*–25*e* of the electronic binary counter 25 there appears its digital count which is transmitted via connections on the one hand to inputs 20*f*–20*k* of comparator 20 and on the other hand inputs 30*a*–30*e* of a further decoder 30. This decoder 30 is followed by a further electronic, programmable read-only memory 31, the decoder 30 being connected via its outputs 30*f*–30*n* to the word-conductor inputs 31*a*–31*n* of memory 31.

The references 30*n* and 31*n* designate here the respective last one of a specific number of connections of the decoder 30 and the memory 31, that number being independent of the alphabetic sequence.

According to the count of the electronic binary counter 25, there is selected via decoder 30 one or another word conductor 31*a*–31*n* of the electronic read-only memory 31 and its programmed word or bit loading is transmitted—after decoding in a further, associated decoder built into the read-only memory 31—to the output leads 32*a*–32*f* thereof. These outputs leads 32*a*–32*f* are electrically joined through an AND gate 33 by way of a connection 34 to the output 26*f* of the pulse timer 26 in order to achieve a narrowing, by superposition upon the brief pulses of timer 26, of the pulses transmitted over the output leads 32*a*–32*f*.

The pulse generator 28 is coupled by way of an input 28*f* and connections 35*a* with a switch (or potentiometer) 35 enabling an adjustment, either in steps or continuous, of the width of the pulses delivered by pulse generator 28 and transmitted to pulse timer 26. This particularly facilitates a variation of the intensity of the emitted signals.

The readout of the read-only memory 31 for the generation of the hour strikes may be realized, e.g., in that an hour strike is generated from memory 31 only with every other clock pulse emitted by the pulse timer 26, i.e. that only every other word conductor 31*a*–31*n* read out in the period of the hour strikes would carry a detectable loading and would give rise to an hour strike upon being addressed. Since, however, not twelve but twenty-four pulses would be delivered in that case by the pulse timer 26 for the hour-signal emission, this may require an enlargement of the electronic counter 25, of the decoder 30 and also of the read-only memory 31. I therefore prefer to set an RS flip-flop (not shown) via an output of the read-only memory 31 at the beginning of the emission of the hour signal whereby—via input 26*g* of the pulse timer 26—the clock frequency thereof is reduced. By this means a quieter, more measured emission of the hour signal or hour strike is made possible. This RS flip-flop is again reset at the end of the emission of the hour signal, either through the comparator 20 or through the RS flip-flop 23, so as to cancel the switchover of the pulse timer 26.

The AND gate 33 is connected via output leads 33*a*–33*f* to a driving circuit 36 through which the power level of the individual outputs of the electronic read-only memory 31 and the AND gate 33 is sufficiently amplified for the actuation of subsequent signal-emitting elements 37*a*–37*f* which are connected by junctions 36*a*–36*f* to the driving circuit 36.

The signal-emitting elements 37*a*–37*f* may be, for example, electromagnetically operated individual bells, electromagnetically actuatable individual gongs or other, individually electrically operable devices, e.g. pipes, which are suitable for the generation of acoustic signals.

By means of an associated selector switch 38, which is respectively connected via output leads 38*a*, 38*b* to an input 32*g* of the read-only memory 31 and to an input 19*g* of the read-only memory 18, a switchover of the column-conductor groups of the corresponding storage matrices or a chip selection is possible. This enables a changeover of the type of acoustic signal to be generated by the signal-emitting elements 37*a*–37*f*. Thus, for example, this changeover enables a switching from the strike mode "Westminster" to the strike mode "Whittington" or "St. Michael".

The switchover of the read-only memory 31 is necessary in any event upon a change in the signal-emission program whereas a switchover of the read-only memory 18 is required only when the number of the individual strikes or individual signals of the signal-emission program to be newly established is different from that of the program still set up.

The means for controlling the pulse generator 15 include, besides the automatically operated switch 8, a manually operable repetition switch 39 which is momentarily closable to cause a pulse emission by generator 15. In this way, if necessary, the signal or strike sequence predetermined in each instance by device 11 on the basis of the position of the hour shaft 10 and the hour-contact disk 12 can be called forth as often as desired. With each new actuation of the repetition switch 39 the strike emission is retriggered, provided of course that the control signal represented by the pattern of energization of the output leads 16*a*–16*d* of hour switch 13 pertaining to a given 15-minute interval is maintained for the duration of that interval.

Owing to the presence of the repetition switch 39, the arrangement for the signal emission can be tested at all times for its operativeness and its setting. Through a remote-control switch the callout of the acoustic time signal can also be effected from a more distant location in order to have available—e.g. at night—an acoustic time indication.

In lieu of the galvanic contacts provided in the minute-contact device 6 and in the hour-contact device 11, the provision of other contact types such as those of photo-optical or magnetic type is possible. These two types of contacts are distinguished by their low susceptibility to malfunction. The galvanic contacts provided in the embodiment of FIG. 1, however, enable a highly compact construction of the two contact devices.

The comparator 20 is connected by its output 20*l* via a connection 14 to the resetting input 23*c* of the RS flip-flop 23. When the comparator 20 detects a coincidence between the binary loading of the inputs 20*a*–20*e* on the one hand and 20*f*–20*k* on the other hand, it emits via its output 20*l* a signal which causes the resetting of flip-flop 23 and thereby the termination of the signal or strike emission.

Output leads 19*h*, 19*i* and 19*k* extend from the electronic read-only memory 18 to a subsequent decoder 40 whose outputs 40*a*, 40*b*, 40*c* extend to the inputs 32*h*, 32*i*, 32*k* of the read-only memory 31. By way of these output leads 19*h*–19*k* an automatic switchover of the strike-emission program during the 12-hour cycle is alternatively possible.

This can be so carried out that during the first half of the 12-hour cycle a first signal program and during the second half of the 12-hour cycle a second signal program can be emitted. A further subdivision of the 12-hour cycle into e.g. four sections of different signal-emission programs is likewise conceivable.

Thus, for example, it is possible to emit
from 6:00 to 9:00 o'clock—Program A,
from 9:00 to 12:00 o'clock—Program B,
from 12:00 to 3:00 o'clock—Program C,
from 3:00 to 6:00 o'clock—Program D.

Through the output leads 19*h*–19*k*, the decoder 40 and the output leads 40*a*–40*c* it is first of all possible to have a program variation in which e.g. program A and program B differ only in their sound sequence, the number of signals or sounds emitted for each ¼-hour strike group being however always the same. By an expansion of the number of contact tracks 12*a*–12*d* of hour disk 12 and of the contacts 13*a*–13*d* of the hour switch 13 as well as the connections 16*a*–16*d* an additional switchover of the scanned word conductors 18*a* to 18*n* by way of decoder 17 is possible so that the aforementioned limitation no longer applies. To this end there are provided a further conductor track 12*e* coacting with the contact 13*e*, a connection 16*e* as well as an input 17*e* of the decoder 17.

However, a switchover is also conceivable in such a way that, for example, during the night hours between 1800 and 0600 hours and between 0600 and 1800 hours different signal or strike programs are respectively emitted. For this purpose, accordingly, a changeover in the program would always have to occur at 0600 and at 1800 hours. In such a case a simpler program could be emitted during the night hours, thus from 1800 to 0600 hours, which is less disturbing while still providing continuing acoustic time information.

For such an arrangement an additional 1:2 transmission ratio between the clock-hand movement 9 or the hour shaft 10 and the hour-contact disk 12 would be useful so that the latter would make a full revolution only in 24 hours. Via the hour-contact disk and the decoder 17 the program switching of 12×12 hours can be performed. To simplify the adjustment in this instance, the 12-hour contact disk 12 then effectively operating as a 24-hour contact disk is provided with an optical index which is observable, e.g., through an aperture in the dial and enables an adjustment of the clock-hand mechanism 9 for daytime and night time.

Also conceivable in this case is a design of the striker clock according to the invention such that the hour-contact disk 12 performs a full revolution in 12 hours but is associated with a time switch, actuatable by the hour shaft 10, which carries out every 12 hours a switchover (chip selection) of the electronic read-only memory 18 so that in this way two 12-hour programs—one for the day and one for the night—are available. Analogously, 4-hour or 6-hour programs could also be emitted.

The read-only memory 31 would have to be concurrently switched via the outputs 19*h*–19*k* of the read-only memory 18 in order to achieve also a change or switchover of the sound sequence from one 12-hour period to the other, if this should be desired.

According to an advantageous feature of the invention, the electronic components represented by frequency divider 3, electronic part of the driving unit 4, pulse generator 15, decoder 17, read-only memory 18, RS flip-flop 23, comparator 20, decoder 40, pulse timer 26, pulse generator 28, binary counter 25, decoder 30, read-only memory 31, AND gate 33 as well as the driving circuit 36 are combined into an electronic module advantageously designed as a dual-in-line chip.

On this LSI module in a dual-in-line package a pin distribution corresponding to the various connections would then have to be provided.

The mode of operation of the striker clock according to the invention pursuant to FIG. 1 is as follows.

From the control quartz 2 of the clockwork 1 the stepping motor of the driving unit 4 is advanced each second via frequency divider 3 and a power or pulse-shaping part of that unit. The minute shaft driven thereby displaces the minute-contact disk 7. At each full ¼ hour, thus at ×:15, ×:30, ×:45 and (×+1):00 o'clock, the switch 8 of the minute-contact device 6 is temporarily closed to trigger the generation of one or more strikes by the selected sound emitter or emitters 37*a*–37*f*. In this way, via the controlled pulse generator 15, the setting input 23*d* of the RS flip-flop 23 is energized by a brief pulse or spike to set that flip-flop. Thereby, in the first place, a continuous zero-setting signal sent to input 25*g* of the binary counter 25 from the reset output 23*a* of the flip-flop by way of the connection 24 is terminated and at the same time, via its set output 23*b* by way of connection 27 and the input 26*a* of the pulse timer 26, the counter is cut in or activated.

Via timer output 26*f* the stepping input 25*f* of the binary counter 25 is then energized with pulses so as to be always advanced from one counting unit to the next. At the same time the hour-contact device 11 emits via disk 12 and hour switch 13, specifically by way of the contact springs 13*a*–13*d*, a data combination, corresponding to the position of the minute and hour hands of the striker clock, to the inputs 17*a*–17*d* of decoder 17. Thereby a corresponding word conductor (18*a*–18*n*) of the electronic read-only memory 18 is selected and its signal code is transmitted—preferably via a decoder associated with that memory—in the shape of a binary data combination by way of output leads 19*a*–19*e* to the inputs 20*a*–20*e* of comparator 20. This data combination corresponds to the number of the individual strikes now to be emitted.

The binary counter 25 stepped forward by the pulse generator 26 selects via outputs 25*a*–25*e* and inputs 30*a*–30*e* of decoder 30 one of the word conductors 30*f*–30*n* of the read-only memory 31 and transfers its data—possibly by way of a further associated decoder—to the output leads 32*a*–32*f* which are connected to the AND gate 33. There a joinder occurs with the brief pulses emitted by the pulse generator 26 which are fed to the AND gate 33 via connection 34.

With the aid of the binary counter 25, which is now continuously advanced during the signal emission, there now occurs via decoder 30 a consecutive selection of word conductors 30*f*–30*n*, one after the other, of the read-only memory 31 and a readout of their loading.

According to the byte read out at any time in read-only memory 31, particular output leads (32*a*–32*f*) thereof are marked which are designed to supply current to those signal-emitting elements (37*a*–37*f*) that are to bring forth sounds or tones during the readout in progress.

The power level of the pulses from output leads 32*a*–32*f*, which are narrowed by joinder with the brief pulses from generator 26 by means of AND gate 33, is raised by means of the subsequent driving circuit 36 in the value required for the actuation of the selected sound emitters 37*a* to 37*f*.

By means of the read-only memory 31 sequentially read from one word conductor to the next, therefore, the nature of the individual signals to be consecutively emitted in the strike sequence about to be generated is determined.

By means of the memory 18 read out via decoder 17, on the other hand, the number of the strikes to be emitted is predetermined, as for instance the emission of eight strikes in a $\frac{1}{4}$ Westminster strike series.

The comparator 20 compares the signal or strike number, read out in binary form from the memory 18, with the binary count of counter 25 and, upon the attainment of coincidence, there is emitted via the output 20*l* of the latter a signal which is transmitted by way of connection 14 to the resetting input 23*c* of RS flip-flop 23 and brings about the resetting thereof whereby the signal emission is terminated.

Via switch 35, as already stated, the width of the pulses emitted at the outputs 33*a*–33*f* of AND gate 33 and at the outputs 36*a*–36*f* of driving circuit 36 is so adjusted that a safe actuation of the selected signal-emitting elements (37*a*–37*f*) is possible. To this end an adjustment of the pulse width over a wide range is necessary since the signal-emitting elements 37*a*–37*f* may comprise sustained-sound generators, e.g. electronic pipes or the like, which are to remain energized for an extended period after a cut-in.

To this end I may provide means for disconnecting the line 34 through a nonillustrated switch from the output 26*f* of the pulse timer 26 and to connect it instead to potential. In this case the selected outputs 33*a*–33*f* of the AND gate 33 and the outputs 36*a*–36*f* of the driving circuit 36 would receive current for the entire duration of a clock period of pulse timer 26, e.g. for 1 or 2 seconds or even longer.

For the control of an electromagnetically or an electrodynamically excitable signal-emitting element 37*a*–37*f* with pulse actuation, on the other hand, a pulse duration of 50 msec to 0.1 sec will suffice for a one-time actuation, such a pulse requiring however a correspondingly higher current intensity.

In the case of energization by a dry-cell battery, generally provided with a clock of this type, a compromise between current intensity and pulse width satisfactory for operation, on the one hand, and mean current consumption, on the other hand, will have to be aimed at.

This adjustment of the intensity or duration of the individual signals is desirable since it enables considerable adaptation to diverse signal-emitting elements. Depending upon the kind of sound emitters used, their excitation or control requires a distinctive command pulse characterized particularly by its width.

As already briefly mentioned, it is possible upon termination of the aforedescribed signal emission to call forth the same again by the operation of the so-called repetition switch 39. This procedure can then be repeated as many times as desired.

Upon the termination of the aforedescribed signal emission, and upon resetting of the RS flip-flop, there occurs via the output 23*a* thereof and the connection 24 a resetting of the binary counter 25 by its input 25*g* so that the same is available for a new counting operation.

The manually operable selector switch 38 facilitates, if necessary, a switchover of the column leads of the storage matrix of the read-only memory 31 and thereby the loading of the word conductors 30*f*–30*n* thereof. For this purpose the connection 38*a*, which may also comprise several individual leads, extends to the input 32*g* of the read-only memory 31.

Together with the storage matrix of the read-only memory 31—if necessary—the storage matrix of the read-only memory 18 may also be switched over, specifically by way of at least one connection 38*b* extending to the input 19*g* of memory 18. A switchover of the latter is then required when the number of the signals to be emitted for the strike sequence to be newly set up by the selector switch 38 is different from that of the previously selected sequence.

In lieu of the switchover of the signal sequence performed by the selector switch 38, such a switchover can also be automatically carried out by the hour-contact device 11 via the read-only memory 18.

A switchover of the read-only memory 31 which may be required in this context is initiated by way of the output leads 19*h* to 19*k* of the read-only memory 18 and the decoder 40 and its output leads 40*a*–40*c*.

In this case a switchover of the outputs 32*a*–32*f* of memory 31 is possible in such a way that they are connectable to diverse groups of signal-emitting elements 37*a*–37*f*. This enables the emission of the acoustic time signals at certain periods by e.g. a glockenspiel and at other times by e.g. a gong-hammer assembly.

This switchover occurs advantageously by a nonillustrated switching stage, to be provided between AND gate 33 and the driving circuit 36, since, on the one hand, suitably narrowed pulses of the outputs 33*a*–33*f* of the AND gate 33 are available at this point while, on the other hand, switching can still be performed at low power. Thus, the driving circuit 36 would have to be correspondingly enlarged, i.e. it would have to comprise correspondingly more inputs and outputs (36*a*–36*f*) and accordingly also more individual amplifier stages. To the outputs (36*a*–36*f* and further ones) of this driving circuit 36 all the signal-emitting elements (37*a*–37*f* and further ones) to be actuated would have to be connected (gongs, bells, electronic pipes, etc.).

It is desirable to combine the switchover of the signal-emitting elements (37*a*–37*f*) with the switchover of the signal programs so that for a given group or type of signal-emitting elements there can also be generated the corresponding appropriate signal-program sequence.

The changeover of the nonillustrated switching stage between AND gate 33 and driving circuit 36 occurs advantageously either manually by the selector switch 38 or automatically, e.g. by the hour-contact device 11 or some other suitable, separate timing switch. This switchover could also be performed via one of the outputs of the read-only memory 31.

The signal-emitting elements (37*a*–37*f*) may be gong hammers or bells with electromagnetic or electrodynamic actuation of the striker or hammer which allow the sounding of a signal tone or strike with each actuation by a pulse emitted by the driving circuit 36.

I may, however, design these signal emitters not as mechanically acting signal-tone generators, which are electromechanically or electrodynamically actuatable, but as oscillator circuits automatically generating sound frequencies by electronic means. When these oscillators are addressed via the driving circuit 36 by the triggered read-only memory 31, they emit a certain sound frequency; with a suitable harmonic tuning of the individual sound-frequency oscillators it is possible to achieve a sound sequence resembling a gong-strike operation.

This arrangement has the advantage that the oscillator circuits can be built in a very compact manner in the smallest space. The generated, harmonically tuned sound frequencies of the oscillators (corresponding to elements 37*a*–37*f*) are fed to an electronic amplifier and are transmitted by the latter to a loudspeaker or some other appropriate electroacoustic transducer which emits the electronically generated acoustic sound sequence in amplified form.

On the other hand, it is also possible with the use of suitable, more complicated circuits, which would have to replace the aforementioned simpler sound-frequency oscillators, to duplicate exactly the sound characteristics of, e.g., hammer gongs, spiral gongs, bells etc. in an electronic manner. In this case, too, the generated sound frequency would have to be fed via an amplifier to an electroacoustic transducer for emission. With these circuits, therefore, the customary sound emitters normally used in striker clocks may be largely replaced with considerable economy of space as well as significant cost savings.

Another desirable further feature of my invention resides in the replacement of the manual strike-sequence changer via selector switch 38 according to FIG. 1 by one using a mechanical/electrical or electronic timing switch. This timing switch executes within certain time periods the switchover, which should be carried out through selector switch 38 by hand, in automatic fashion. The strike sequence can change in this case in a daily cycle but could also vary in a weekly cycle so that e.g. at the weekend, i.e. on Sundays, another, e.g. more extended and fuller-sounding, strike sequence is emitted whereas on weekdays a more utilitarian strike sequence serving for the acoustic time information comes into use.

Figure 2:
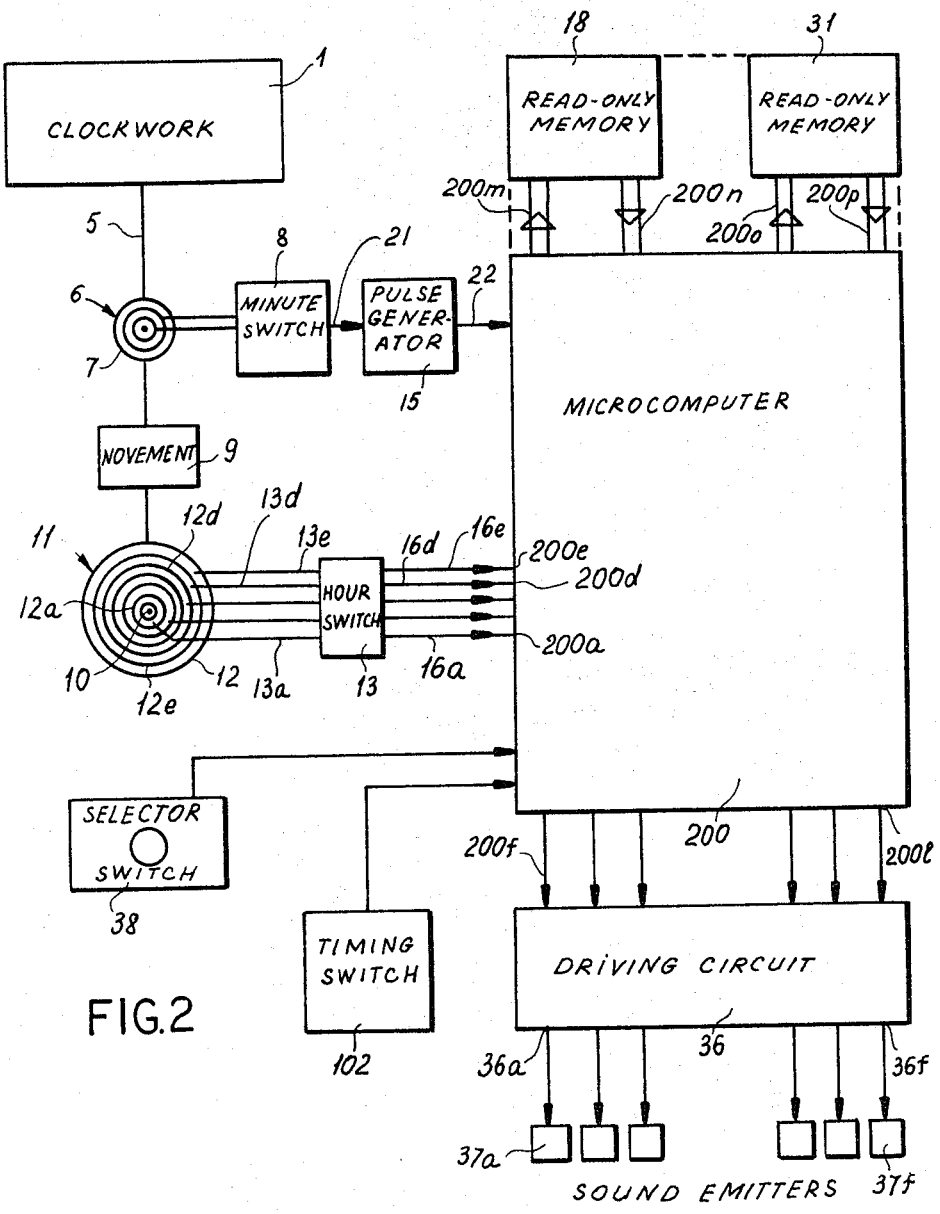
FIG. 2 represents a block diagram of a second embodiment of the invention.

The rather voluminous switching arrangement illustrated in FIG. 1 and described above may be replaced by a microcomputer 200 as shown in FIG. 2.

The microcomputer 200 comprises a central unit (CPU) effecting the control of the electronic buffer stores for the data generated during the progress of an operation, i.e. the emission of a signal sequence, which are to be further processed, at least one timer for determining the clock sequence of the operating step, as well as modules for the feed-in and the feed-out of the control data or pulses.

As program memories there are provided two electronic read-only memories which, in a manner similar to that of the switching arrangement according to FIG. 1, determine on the one hand the number and on the other hand the nature of the signals to be emitted. Their triggering occurs in the first place in response to the data transmitted from the hour-contact device 12 to the inputs 200*a*–200*e* of the microcomputer 200 and furthermore through the readout performed during the processing of these data (number of strikes) by the microcomputer 200 for the requisite signal emission.

With the arrangement of FIG. 2 the triggering of the signal emission is again effected by the minute-contact device 6 which preferably is temporarily actuated every ¼ hour (15, 30, 45, 00 minutes) and initiates the signal emission through the microcomputer by way of a pulse-generator circuit 15. The emission of the signals occurs by way of the outputs 200*f*–200*l* that are followed by a driving circuit 36 which in turn performs the control of the signal-emitting elements 37*a*–37*f* via outputs 36*a*–36*f*.

With the aid of a timing switch 102 the emission of a higher-order time program to the microcomputer 200 is possible. This enables an automatic switchover of the signal sequence of the microcomputer so that at certain hours of the day or on certain days of the week one or more signal-emission programs can be put into effect.

In lieu of the timing switch 102 there can also be provided a manually actuatable selector switch 38 with which, if needed, a permanent change in the kind of signal sequence to be emitted in a given case by the microcomputer 200 can be carried out.

The configuration of a microcomputer according to FIG. 2 enables just like that of the switching arrangement according to FIG. 1 a wide variation of the signal sequence to be emitted by automatic or manual switchover. It is further advantageous that, for the given task, a commercially available well-known microcomputer system can be used which can be supplemented by the corresponding modules and the necessary additional logic. Moreover, the space requirement for the electronic circuitry can be substantially reduced through the use of a microcomputer system.

The nonillustrated microprocessor (CPU), the actual control unit of the microcomputer, has to be provided with its own internal function cycle which is variable through the inclusion of read-only memories in a manner corresponding to operation with a logical circuitry composed of individual logical elements. This internal cycle of the microprocessor can be modified in diverse ways through the inclusion of several program memories (preferably read-only memories) so that with one and the same basic unit (CPU etc.), but through inclusion of different program memories, the most diversified function of a hard-wired circuitry consisting of individual logical elements can be duplicated. Since this basic unit is practically always the same, it will occur in larger quantities and can therefore be economically manufactured and purchased despite its very complicated and extensive structure.

This concept is inherently suitable also for the structuring of the electronic circuit arrangement for the electric clock since it enables a widespread modification and variation of the signal programs to be emitted without requiring more extensive inner-circuital changes or adjustments for this purpose.

The function of the computer system according to FIG. 2 for use as control circuitry with the clock, is such that, upon the triggering of the working cycle of the microcomputer by the pulse generator 15, the data combination (pattern of energization of contacts 13*a*–13*e*) emitted by the switch 13 of the hour-contact device 11 is received, decoded and processed. In accordance therewith the corresponding instruction for the signal combination is called forth in the read-only memory 18. For a 12-hour program of a striker clock according to the invention a total of $12 \times 4 = 48$ signal emissions are to be produced, namely:

| | |
|---|---|
| 00:15 o'clock | 01:15 o'clock |
| 00:30 o'clock | 01:30 o'clock |
| 00:45 o'clock | 01:45 o'clock |
| 01:00 o'clock | 02:00 o'clock etc. until |
| 11:15 o'clock | |
| 11:30 o'clock | |
| 11:45 o'clock | |
| 12:00 o'clock | |

For the emission of these signal combinations an hour-contact device 11 indicating $2^6=64$ bit combinations would be required in order to be able to transfer the 48 signal combinations from clockwork 1 to microcomputer 200. The 48 signal combinations would then be called forth, successively, according to the emitted bit combinations of the hour-contact disk 12 and the hour switch 13 via the read-only memory 18, decoded, and—possibly with the assistance of read-only memory 31—successively treated by the processor and sent out via signal-emitting elements 37*a*–37*f*.

The 48 signal combinations, however, generally contain $48-16=32$ redundant signals since the signal sequences at 15 min., 30 min., 45 min. recur as a rule always identically, without an hour strike, and can thus be always transmitted by one and the same bit combination of the hour-contact device 11 to the microcomputer 200. This number of signals, however, can just be unequivocally marked by $2^3=16$ bit combinations enabling a considerably simpler arrangement of the hour-contact device 11. These signal combinations are 15 min.
30 min (3 signals for $\frac{1}{4}$ strike)
45 min.

and

| | | |
|---|---|---|
| 1 hr. 00 min. | 7 hr. 00 min. | |
| 2 hr. 00 min. | 8 hr. 00 min. | (12 4/4 strikes with |
| 3 hr. 00 min. | 9 hr. 00 min. | respectively associ- |
| 4 hr. 00 min. | 10 hr. 00 min. | ated hour strike |
| 5 hr. 00 min. | 11 hr. 00 min. | 1–12) |
| 6 hr. 00 min. | 12 hr. 00 min. | |

The emission of 48 codings by the hour-contact device 11 and the disk 12, i.e. respective markings of the hour strike in connection with $\frac{1}{4}$-hour strikes to be emitted, is of interest only when for special purposes, e.g. in the case of repetition, with each $\frac{1}{4}$-hour strike there is also to be emitted the hour strike characterizing the position of the hour hand in order to make it possible to learn, e.g. at night, the approximate time solely from the acoustic time indication.

The signal sequence marked by the hour-contact device 11 is transmitted by the computer system 200 via outputs 200*f* to 200*l* and driving circuit 36 by way of its outputs 36*a* to 36*f* to the signal-emitting elements 37*a* to 37*f*.

During the signal emission by the microcomputer 200 the read-only memories 18 and 31 are addressable by way of inputs 200*m* and 200*o* through the associated microprocessor and are readable by same via outputs 200*n* and 200*p*.

Through operation of the selector switch 38 or the effect of the timing switch 102, different signal sequences can be emitted also with the microcomputer control of the striker mechanism pursuant to FIG. 2. This is possible because of the fact that the microprocessor, during the progress of the cycle, is always caused to call forth the control-instruction combinations on different column groups or chips of the read-only memory 18 or 31.

The modules of the microcomputer (CPU, ROM, RAM, additional logic, input and output elements etc.) are connected to one another and to the microprocessor by bus bars whose direction and sequence of transmission can be changed, e.g. according to the multiplex procedure, so that by way of these bus bars it is possible to carry out the transfer of the data exchanged between the individual modules and the microprocessor unit which determine the strike sequence to be emitted.

In the emission of a signal or strike sequence by the arrangement according to the invention it must be made certain that also the last-emitted signal is to be sounded or made audible in its full temporal length. This is particularly important when a signal sequence consisting of longer-lasting signals, e.g. generated by an oscillator and transmitted via an electroacoustic transducer, is to be emitted with individual signals which may last e.g. for one second or longer.

With the circuit arrangement according to FIG. 1 it is necessary in this case, for example, according to an advantageous realization of the invention, that upon the triggering of the last signal or strike of a signal sequence by the electronic counter 25 there is not also initiated immediately the termination of the signal emission via comparator 20 and RS flip-flop 23. At least a suitable delay between the initiation of the last strike of a signal sequence and the emission of the cancellation signal at the input 23*a* of the RS flip-flop 23 by the comparator 20 must be provided so that prior to a termination of the signal emission also the last signal can be safely emitted in its full length or effect.

With the switching arrangement according to FIG. 1 I may logically interconnect the output 20*l* of comparator 20 and the output 26*f* of the pulse timer 26, according to the expression $Y=\overline{26f}\cdot 20l=L$, which means that the output 20*l* of comparator 20 and the output 26*f* of the pulse timer 26 would have to be logically joined together via an AND gate with the input 23*a* of the RS flip-flop 23, with negation of the gate input connected to the output 26*f*. Analogously, of course, any other type of joinder may be used which corresponds to the logical condition set forth above.

I claim:

1. In a striker clock having time-indicating means driven by a clockwork and further having sound-emitting means operable at predetermined time intervals, the combination therewith of:

switch means mechanically coupled with said clockwork for producing a succession of control signals changing from one time interval to the next;

memory means for storing a multiplicity of numerical values each representing a number of strikes associated with a respective time interval occurring during a 12-hour period, said memory means being addressable by said switch means for reading out the respective numerical value during each time interval of said period;

normally inactive conversion means connected to said memory means for translating said numerical value into a corresponding number of excitation commands for said sound-emitting means; and trigger means mechanically coupled with said clockwork for activating said conversion means at a given instant in each time interval.

2. The combination defined in claim 1, wherein said clockwork has an hour shaft and a minute shaft, said switch means comprising a rotary track carrier coupled with said hour shaft and a set of contacts coacting with respective tracks on said carrier, said trigger means comprising a pulse generator controlled by said minute shaft.

3. The combination defined in claim 2, further comprising a manual switch connected to said pulse generator for actuating same independently of said minute shaft to read out said memory means and operate said sound-emitting means at times other than said given instant.

4. The combination defined in claim 1, 2 or 3 wherein said memory means comprises a first read-only memory, said conversion means including a second read-only memory storing a program for varying the mode of excitation of said sound-emitting means in different time intervals.

5. The combination defined in claim 4 wherein said sound-emitting means comprises a multiplicity of selectively operable sound emitters.

6. The combination defined in claim 4 wherein said first and second memories are interconnected for modifying said program in different subdivisions of said 12-hour period.

7. The combination defined in claim 1, 2 or 3 wherein said conversion means includes a microcomputer.

8. The combination defined in claims 7 wherein said memory means comprises a first read-only memory, said conversion means further including a second read-only memory storing a program for controlling said microcomputer to vary the mode of excitation of said sound-emitting means in different time intervals.

9. The combination defined in claim 1, 2 or 3 wherein said conversion means includes a normally reset flip-flop settable by said trigger means, a source of stepping pulses, a binary counter connected to said source for advancement by said stepping pulses, such advancement being inhibited by said flip-flop in the reset state thereof, and a comparator with inputs connected to said counter and to said memory means for resetting said flip-flop together with said counter upon the reading of said counter matching the numerical value read out from said memory means.

10. The combination defined in claim 9 wherein said memory means comprises a first read-only memory, said conversion means further including a second read-only memory addressable by said counter for reading out said excitation commands stored therein.

11. The combination defined in claim 10 wherein said sound-emitting means comprises a multiplicity of selectively operable sound emitters, said excitation commands being directed to selected sound emitters according to a program stored in said second memory and controlled by said first memory.

12. The combination defined in claim 9 wherein said conversion means further includes logical gate means with input connections to said memory means and to said source for limiting the duration of each excitation command to the width of a stepping pulse.

* * * * *